United States Patent [19]

Gamache

[11] Patent Number: 4,886,083

[45] Date of Patent: Dec. 12, 1989

[54] VEHICLE COVER

[76] Inventor: Mark Gamache, 86 Pelham St., Springfield, Mass. 01109

[21] Appl. No.: 310,581

[22] Filed: Feb. 15, 1989

[51] Int. Cl.[4] ..... E04H 15/06

[52] U.S. Cl. ..... 135/88; 135/97; 135/101; 135/109; 135/112

[58] Field of Search ..... 135/88, 97, 101, 102, 135/106, 109, 112, 103

[56] References Cited

U.S. PATENT DOCUMENTS

| | | | |
|---|---|---|---|
| 2,598,940 | 6/1952 | Robie | 135/88 X |
| 2,798,501 | 7/1957 | Oliver | 135/102 |
| 2,858,837 | 11/1958 | Harper | 135/102 |
| 3,036,583 | 5/1962 | Miller | 135/102 |
| 3,465,765 | 9/1969 | Dietz | 135/3 |
| 3,802,450 | 4/1974 | Huddle | 135/102 X |
| 3,995,649 | 12/1976 | Robichard | 135/102 |
| 4,306,390 | 12/1981 | Brown | 52/67 |
| 4,402,544 | 9/1983 | Artim et al. | 135/102 X |

OTHER PUBLICATIONS

Carcoon, Patent Pending, Bolder Designs for Sante Fe, N.M. 87505.

*Primary Examiner*—David A. Scherbel
*Assistant Examiner*—Lan Mai
*Attorney, Agent, or Firm*—Robert A. Seemann

[57] ABSTRACT

Portable cover for vehicle has foldable frame with weather resistant flexible sheet. A ground-rail on each side of the vehicle includes support bars redoubtably mounted on the ground-rail, the bars supporting the weather resistant sheet and being connected over the top of the vehicle. The redoubtably mounted bars are arranged in pairs so that they can be folded over the vehicle, or folded down to the ground beyond the ground rails. For larger vehicles, each ground-rails includes a track, and the support bars are mounted for sliding along a portion of the length of the relatively parallel tracks. Flanges mounted on support bars at the ends of the ground-rails receive wheels of the vehicle for anchoring down the portable cover and for fastening down an end of the frame when it is closed over the vehicle.

5 Claims, 5 Drawing Sheets

VEHICLE COVER

BACKGROUND OF THE INVENTION

1. Field of the Invention

This invention relates to canopies, more specifically to a collapsible cover and frame for covering a mobile vehicle such as a car or motorcycle.

2. Description of the Prior Art

One canopy for vehicles is disclosed by Henry Dietz, in U.S. Pat. No. 3,465,765, patented Sept. 9, 1969. It is a two part shelter with one part being stationary and the other part being movable.

The stationary portion has a shell-like, arcuate, upstanding section, mounted on a flat horizontal plate which is anchored to the ground by the weight of a vehicle.

In the open canopy position, the stationary portion is nested within a higher shell-like, arcuate, upstanding movable section which is hinged near the plate, at the open ends of the shells, and operated by a lever and counterbalancing spring for rotation between the upstanding vertical and a horizontal position.

A vehicle is driven into the stationary portion with the apparatus in the open canopy position, the rear part of the vehicle extending out of the stationary portion. The movable portion of the canopy is then levered down over the vehicle to a horizontal position whereupon it rests upon the ground around the rear part of the vehicle, so that the canopy encloses the vehicle.

In U.S. Pat. No. 4,306,390, Maurice L. Brown discloses two upstanding, pivotally joined, nested shells. Both the smaller and the larger shells are movable from the vertical to a horizontal position. The pivot is attached to a base which extends sufficiently to form a vehicle encompassing enclosure with the shells, when they are rotated to it horizontally, with the pivot at the center. The shells are flanged along one edge to form a weather seal across the top of the enclosure when they are both down.

In the open canopy position, a vehicle is driven onto the base from the open shells'side, whereby it is covered at the front by the nested shells. One of the two shells is then rotated to the base over the exposed end of the vehicle to form a weather resistant enclosure.

A portable canopy, trademarked CARCOON, patent pending, disclosed by Bolder Designs, Inc., Sante Fe, N.M. 87505, includes a weather resistant fabric over a frame having movable end portions.

The frame has two pivots fastened to the ground on each side of the canopy. The pivots are fastened apart from one another at a distance that is about equal to one third of the length of the canopy, fastening being by lag bolt or epoxied ground pads.

Outboard of each pivot is a movable support bar which attaches to the pivot on the other side of the canopy by way of a spacer bar across the top and a movable support bar similarly attached to the pivot on the other side of the canopy. This forms an inverted U shaped, rotatable support for each end of the enclosure.

A pair of support bars mounted to the pivots, cross one another inboard of each pivot, and are fastened together where they cross in an X. The crossed pair is joined across the top to a similar pair on the other side of the canopy, by a pair of parallel spacer bars.

The crossed center portion of the frame provides a fixed, rigid box-like enclosure, while either end of the enclosure is rotated upward to permit entry of a vehicle to the enclosure.

Alternatively to lag bolt or epoxied ground plate mounting, water ballast bladders are provided to weigh down the frame wall sides and ends.

SUMMARY OF THE INVENTION

It is one object of the invention to provide a portable cover for a vehicle, the cover having a one piece top,.

It is another object of the invention to provide a portable cover that fully collapses to the ground.

It is another object of the invention to provide a portable cover that fully collapses to the ground from an assembled state without disassembly.

It is another object of the invention to provide a portable cover that is held to the ground by the weight of the vehicle.

It is yet another object to provide a portable cover that is held on the ground by lag bolts.

In accordance with the invention there is provided a portable cover for a vehicle, the vehicle having a first side, a second side, a first end, a second end, and at least one wheel at each end. The cover includes a foldable frame and weather resistant flexible sheet means attached to the frame so that the vehicle is protected from the weather.

The frame includes a first ground-rail on the first side of the vehicle, and a second ground-rail on the second side of the vehicle. The first ground-rail comprises a first track, and the second ground-rail comprises a second track. The two tracks are generally parallel to each other, and have a first end and a second end.

A plurality of pairs of support bars are provided, one bar on each pair is mounted by a first end on the first ground-rail and the other bar of the pair is mounted by a first end on the second ground-rail, the two bars of each pair being generally coplanar with one another.

Of the plurality of pairs of support bars, a first pair is mounted near the first end of the tracks and a second pair is mounted near the second end of the tracks.

A third pair of the support bars is located between the first and second pair of support bars, the third pair being mounted by means for sliding for traveling a length of the track.

Each pair of support bars comprises a spacer bar at second ends of each support bar of that pair.

The mounting of the support bars, further, is by rotatable mounting means wherein the pairs of support bars are rotatable about the rotatable mounting means in a vertical arc that is coplanar with a line that is parallel with the tracks. The support bar pairs are rotatable toward the ground so that the spacer bars fall beyond the ends of the support bar locations on the ground-rails.

For use with short base vehicles, the support bars are located on the ground-rail by means for rotation, without the means for sliding.

Flanges for receiving wheels of the vehicle are located on the first and second pair of support bars for holding the flanged bars to the ground.

The track includes tubular means which include a longitudinal opening for receiving the means for sliding, and the means for sliding comprises roller means, angled in the tube for transmitting lateral force from the support bars with reduced rolling friction.

A spacer ground strip is attached between the support bars of the first pair of support bars, including attachment to the flange. Similarly, a spacer ground strip is attached between the support bars of the second pair of support bars, including attachment to the flange.

Alternatively, the spacer ground strips are attached between the ground-rails near the ends of the ground-rails.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
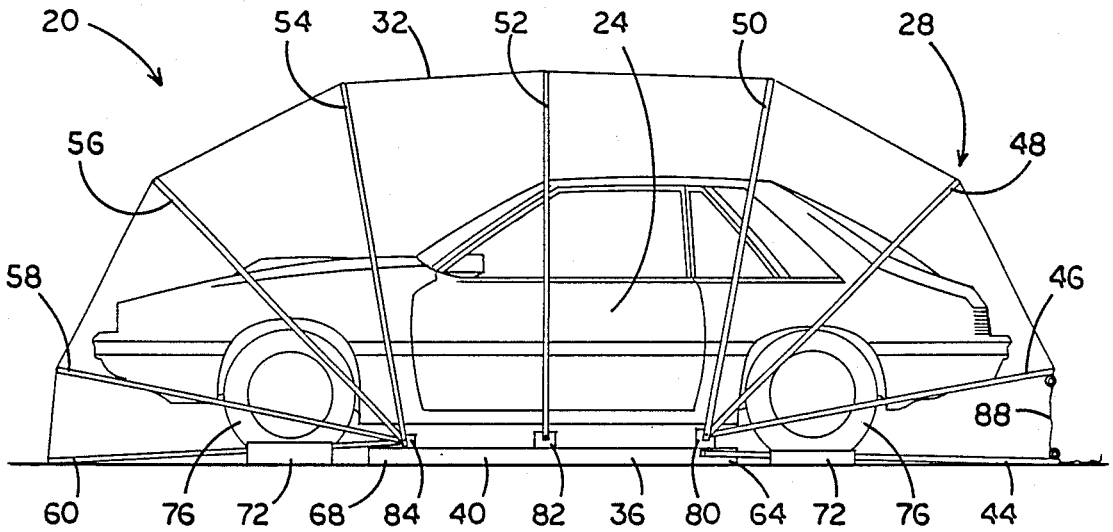
FIG. 1 is a schematic view of a vehicle cover according to the invention, showing the cover enclosing a vehicle.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1, portable cover 20 is shown closed over vehicle 24. Frame 28 supports weather resistant flexible sheet 32 which may be made, for example, from reinforced vinyl, or rubberized cloth.

Frame 28 includes ground-rail 36 which includes track 40. Support bars 44 and 60 which are mounted on ground-rail 36 are located near ends 64 and 68 respectively of track 40. Support bars 44 and 60 include flanges 72 which receive wheels 76 of vehicle 24 that hold the bars to the ground. Support bars 46, 48, 50, 52, 54, 56, and 58 also, are mounted on ground-rail 36.

Support bar 52, located between support bars 44 and 60, is mounted on ground-rail 36 by means for sliding (later described with respect to FIG. 6) for travel of support bar 52 over a length of track 40. Also mounted by means for sliding comprising plate 80, are support bars 46, 48, and 50, and mounted by means for sliding comprising plate 84 are support bars 54, 56, 58 and 60. Plates 80, 82, and 84 slide along portions of track 40. Support bar 44 is mounted fixed against sliding.

Figure 2:
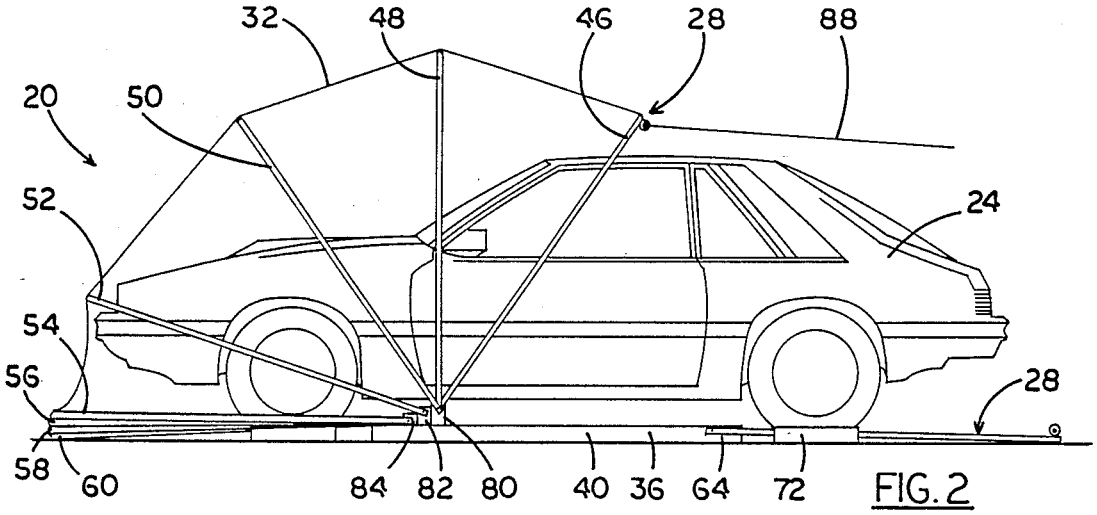
FIG. 2 is a schematic view of the vehicle cover partially closed over a vehicle.
Figure 3:
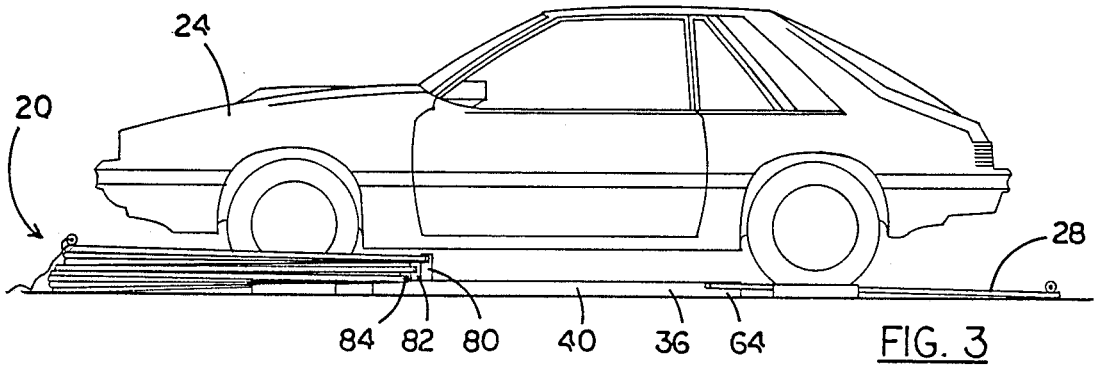
FIG. 3 is a schematic view of the vehicle cover open, with a vehicle in, place over the frame.

The mounting of support bars 46, 48, 50, 54, 56 and 58 is also by means for rotation (FIG. 6), so that the cover can be open and collapsed to the ground as shown in FIGS. 2 and 3. Support bars 44 and 60 are also mounted by means for rotation for reverse folding, or for reducing the overall length of the frame when collapsed without vehicle. Although support bar 44 is shown to be mounted fixed against sliding, it may also be attached to ground-rail 36 by means for sliding, so that support bar can be moved to the same end of the frame as the other support bars when the frame is collapsed without vehicle.

Weather resistant flexible sheet 32 is attached to the ends of support bars 46, 48, 50, 52, 54, 56, 58 and 60 by straps, longitudinal pockets or other suitable means, enclosing vehicle 24 in a weather resistant cover. Support bar 46 is drawn toward support bar 44 by hold-down cord 88.

FIG. 2 shows frame 28 half collapsed, with hold-down cord 88 disconnected, and plates 84, 82, and 80 slid to end 68 of track 40.

FIG. 3 shows frame 28 fully collapsed, with vehicle in place within the frame.

Figure 4:
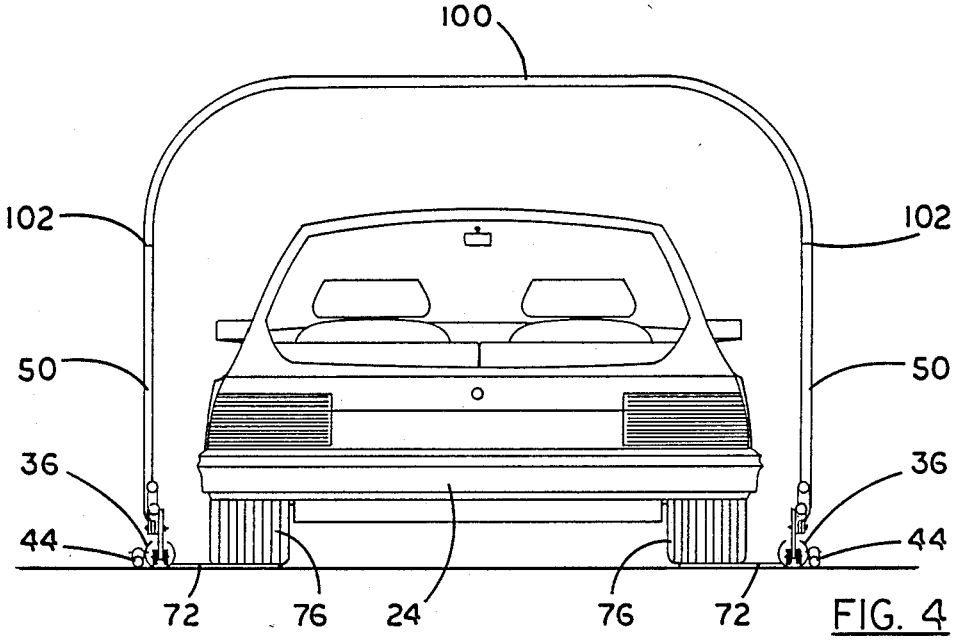
FIG. 4 is a schematic rear view showing a portion of the frame over a vehicle.
Figure 11:
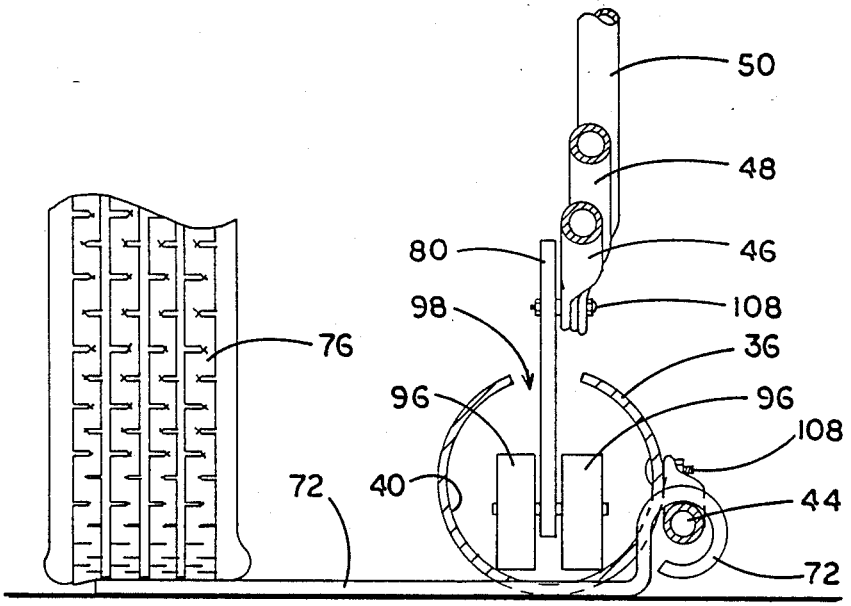
FIG. 11 is a schematic rear view of a portion of the frame.

FIGS. 4 and 11, by way of example of construction of both ends of the frame, show in partial rear view, the frame held to the ground by way of vehicle wheel 76 upon a flange 72, expressed through support bar 44, which is rotatably attached by pivot 108 to ground-rail 36. Ground-rail 36 comprises track 40 in the form of a tube which receives plate 80 and wheels 96 through opening 98 which extends along a substantial portion of the track. One end of track 40 is left open during the initial assembly to receive wheels 96. Portions of several support bars, and all of support bar 50 is shown.

Support bar 50 is connected with complementary support bar 50 on the other side of the vehicle, by spacer bar 100 at slip joint 102. The spacer bar and slip joint arrangement is preferred for convenience of packing and shipping of the disassembled frame. A unitary flexible rod or tube may be used instead of the three sections. The support bars are preferably made from galvanized steel or aluminum, while the spacer bars are preferably made from fiberglass.

On the opposite side of the vehicle, complementary twin parts complete the frame, exemplified by like part designator numbers 50, 36, 44, and 72, shown in FIG. 4 on both sides of the set of vehicle wheels.

Figure 5:
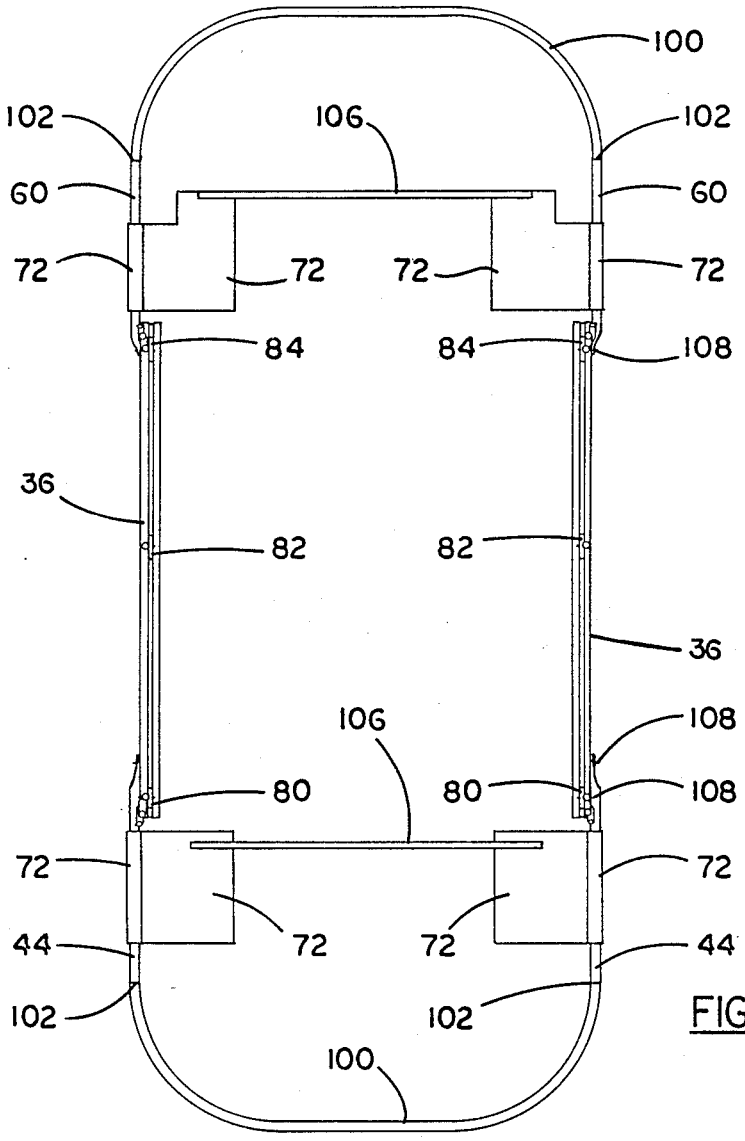
FIG. 5 is a schematic top view of a portion of the frame.

FIG. 5 shows a frame 28 with spacer ground strips 106 between flanges 72. Although not shown, the spacer ground strips may be between the ground rails. The spacer ground strips are used if necessary, to resist tendency of the ground-rails to move apart under lateral force from prestressed support bar/spacer bar assemblies.

Figure 6:
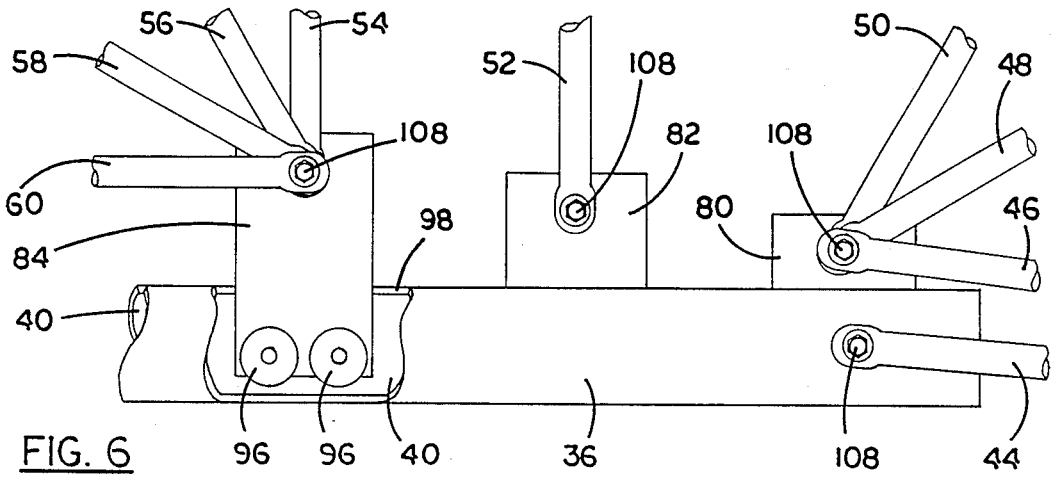
FIG. 6 is a schematic side view of a portion of a ground-rail including track and slidably mounted support bars.

Referring to the portion of ground-rail 36 shown in FIG. 6, the ground-rail receives plate 84 with support bars 60, 58, 56 and 54 rotatably mounted by means of pivot 108, plate 82 with support bar 52 rotatably mounted on pivot 108, plate 80 with rotatably mounted support bars 46, 48 and 50. The support bars are also mounted for sliding along in track 40 by means of plates 84, 82 and 80 being received in track 40 by way of opening slot 98 which runs along a portion of the length of track 40, and wheels 96 that run within the tubular track.

Support bar 44, although rotatably mounted on the ground-rail near one end of track 40, is fixed against sliding by the location of pivot 108 on ground-rail 36. Although fixing support bar 44 against sliding is preferable to provide a tie point for hold-down cord 88 that is secured by vehicle wheel weight, a ground-stake can be substituted for support bar 44.

Figure 7:
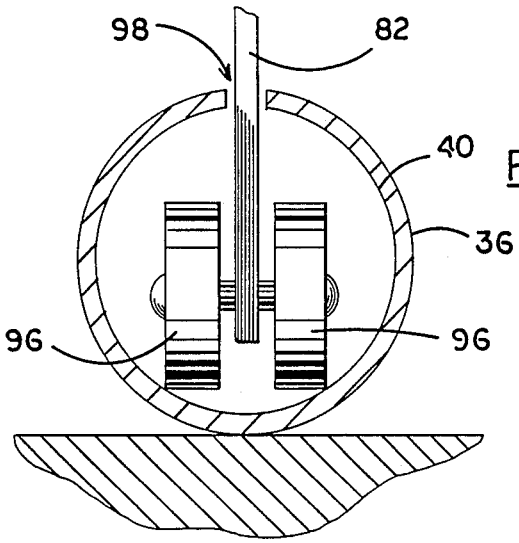
FIG. 7 is a cross section view of a tubular track with slidable mounting means.
Figure 8:
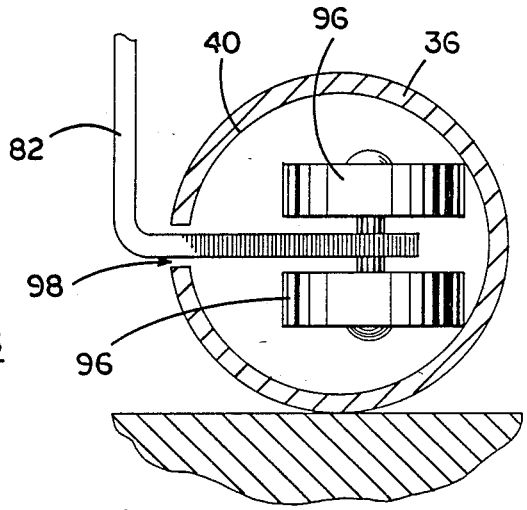
FIG. 8 is a cross section view of a tubular track with slidable mounting means.

FIGS. 7 and 8 show two preferred arrangements for wheels within tubular track 40. Plate 82 is bent in order to transmit lateral force from support bar 52 (not shown) at an angle which will reduce rolling friction. Surprisingly, an angle approaching 90 degrees provides low rolling friction without side wheel interference.

Figure 9:
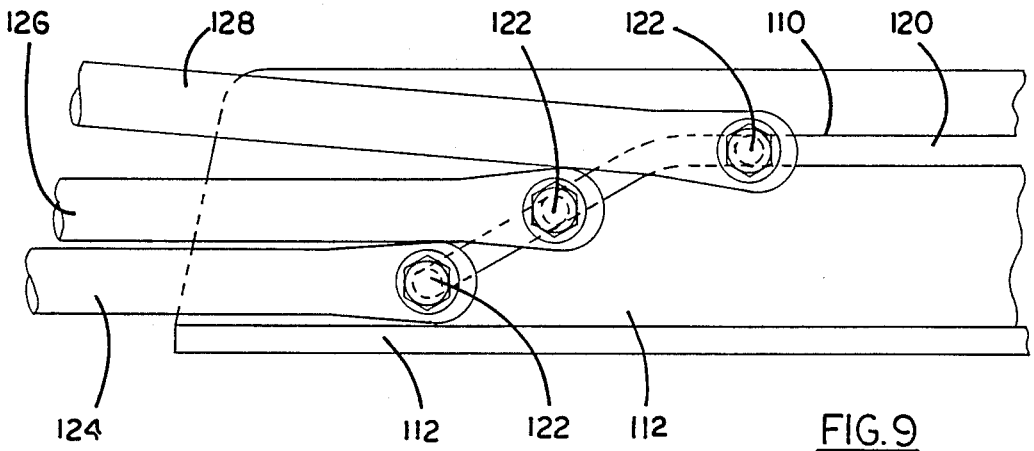
FIG. 9 is a schematic view of a portion of a T track with slidable mounting means.

The track preferably is tubular in form. This need not be the case, however, as shown in FIG. 9. Ground-rail 112 includes track 110 in the form of a T-beam. Opening 120 receives pivots 122. Support bars 124, 126 and 128 are rotatably and slidably mounted on ground-rail 112 by means of pivots 122.

Figure 10:
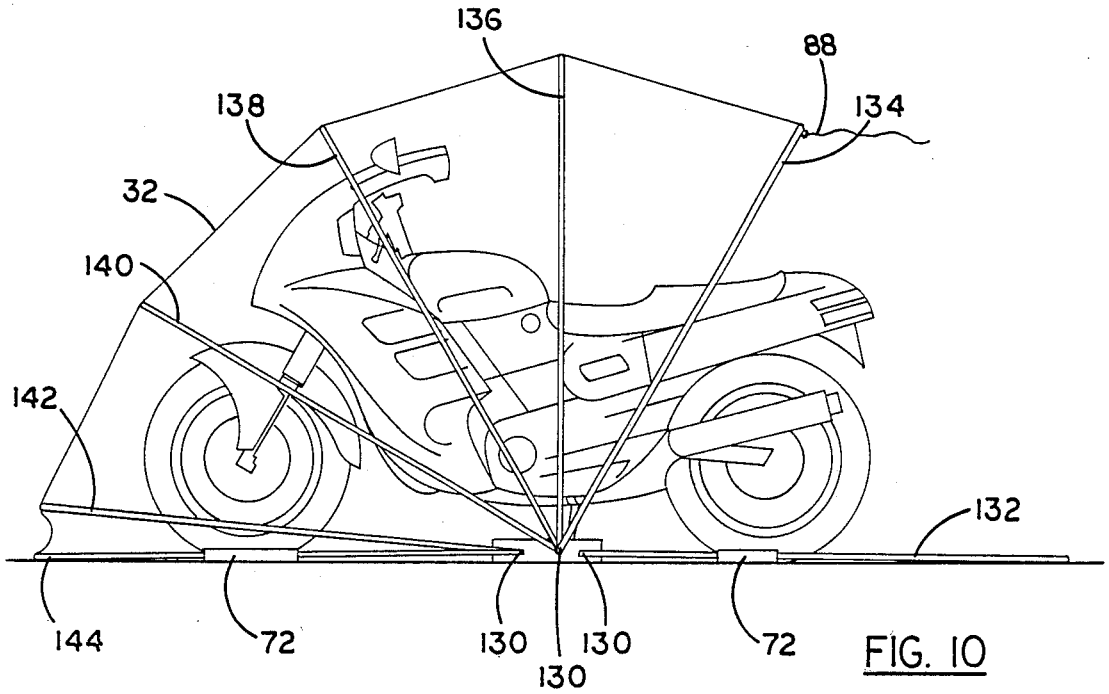
FIG. 10 is a schematic view of a vehicle cover according to the invention, partially closed over a vehicle.

FIG. 10 shows an arrangement for accommodating a small two-wheeled vehicle. Flanges 72 on support bars 132 and 144 connect to the complementary parallel support bars (not shown) on the opposite side of the vehicle for extra rigidity. Support bars 132, 134, 136, 138, 140, 142 and 144 are rotatably mounted on ground-rail 150 by means of pivots 130. Without the vehicle, the assembly conveniently collapses with all support bars on both sides of the vehicle rotated for stacking generally over bar 144. Slidable mounting of the support bars on the ground-rail is not necessary in this case.

To use the portable vehicle cover 20, frame 28 is assembled, flexible sheet 32 is attached to the frame, and the cover is collapsed to the ground. Flanges 72 are moved to the appropriate location on the support bars to accommodate the distance between the wheels of the vehicle. The vehicle is moved over the fiberglass spacer bar of the end set of support bars, and on to the flanges. The fiberglass bars are designed to accept such passage without damage.

The support bar frame is then moved up at the leading end of the vehicle, over the vehicle, and down behind it to enclose the vehicle. The leading pair of support bars are then tied down behind the vehicle to the flange-anchored support bars.

Alternatively, all support bars are joined to the flexible sheet during assembly. Then the leading pair of support bars are tied down to a spike or other ground-fastener.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A portable cover for a vehicle having a first side, a second side, a first end, a second end, a wheel at said first end, and a wheel at said second end, said cover comprising:

a foldable frame and weather resistant flexible sheet means attached to said frame for protecting the vehicle from weather, said frame comprising a first ground-rail on said first side, and a second ground-rail on said second side, said first ground-rail comprising a first track, and said second ground-rail comprising a second track, said second track being generally parallel to said first track, said two tracks having a first end and a second end, a plurality of pairs of support bar means, one bar of each pair being mounted by a first end on said first ground-rail and the other bar of the pair being mounted by a first end on said second ground-rail, the two bars of each pair being generally coplanar with one another, of said plurality of pairs of support bar means:

a first pair of said support bar means mounting being near said first end of the tracks, a second pair of said support bar means being mounted near said second end of the tracks, a third pair of said support bar means being mounted between said first and second pairs, said mounting by said third pair being by means for sliding for traveling a length of said track, each of said support bar means including a second end, and each pair of support bar means comprising a spacer bar at said second ends of said support bar means of said each pair, the mounting of said second and third pair of support bar means further comprising rotatable mounting means, said second and third pairs each being rotatable about said rotatable mounting means in a vertical arc that is coplanar with a line that is parallel with the tracks, the mounting of said first pair of said support bar means comprising means for fixing said first pair against traveling the track, and further comprising rotatable mounting means, said first pair being rotatable about said rotatable mounting means in a vertical arc that is coplanar with a line that is parallel with the tracks, flange means mounted on a bar of said first pair of said support bar means, and on a bar of said second pair of said support bar means, said flange means for receiving wheels of said vehicle for holding said flanged bars to the ground.

2. A portable cover for a vehicle having a first side, a second side, a first end, a second end, a wheel at said first end, and a wheel at said second end, said cover comprising:

a foldable frame and weather resistant flexible sheet means attached to said frame for protecting the vehicle from weather, said frame comprising a first ground-rail on said first side, and a second ground-rail on said second side, said first ground-rail comprising a first track, and said second ground-rail comprising a second track, said second track being generally parallel to said first track, said two tracks having a first end and a second end, a plurality of pairs of support bar means, one bar of each pair being mounted by a first end on said first ground-rail and the other bar of the pair being mounted by a first end on said second ground-rail, the two bars of each pair being generally coplanar with one another, of said plurality of pairs of support bar means:

a first pair of said support bar means mounting being near said first end of the tracks, a second pair of said support bar means being mounted near said second end of the tracks, a third pair of said support bar means being mounted between said first and second pairs, said mounting by said third pair being by means for sliding for traveling a length of said track, each of said support bar means including a second end, and each pair of support bar means comprising a spacer bar at said second ends of said support bar means of said each pair, the mounting of said second and third pair of support bar means further comprising rotatable mounting means, said second and third pairs each being rotatable about said rotatable mounting means in a vertical arc that is coplanar with a line that is parallel with the tracks, said track comprising tubular means including a longitudinal opening for receiving said means for sliding.

3. A portable cover for a vehicle having a first side, a second side, a first end, a second end, a wheel at said first end, and a wheel at said second end, said cover comprising:

a foldable frame and weather resistant flexible sheet means attached to said frame for protecting the vehicle from weather, said frame comprising a first ground-rail on said first side, and a second ground-rail on said second side, said first ground-rail comprising a first track, and said second ground-rail comprising a second track, said second track being generally parallel to said first track, said two tracks having a first end and a second end, a plurality of pairs of support bar means, one bar of each pair being mounted by a first end on said first ground-rail and the other bar of the pair being mounted by a first end on said second ground-rail, the two bars of each pair being generally coplanar with one another, of said plurality of pairs of support bar means:

a first pair of said support bar means mounted being near said first end of the tracks, a second pair of said support bar means being mounted near said second end of the tracks, a third pair of said support bar means being mounted between said first and second pairs, said mounting by said third pair being by means for sliding for traveling a length of said track, each of said support bar means including a second end, and each pair of support bar means comprising a spacer bar at said second ends of said support bar means of said each pair, the mounting of said second and third pair of support bar means further comprising rotatable mounting means, said second and third pairs each being rotatable about said rotatable mounting means in a vertical arc that is coplanar with a line that is parallel with the tracks, said track comprising tubular means including a longitudinal opening for receiving said means for sliding, said means for sliding, comprising roller means within said tube for traveling a length of said tube, said roller means being angled within the tube for transmitting lateral force from the support bar with reduced rolling friction.

4. A portable cover for a vehicle having a first side, a second side, a first end, a second end, a wheel at said first end, and a wheel at said second end, said cover comprising:

a foldable frame and weather resistant flexible sheet means attached to said frame for protection the vehicle from weather, said frame comprising a first ground-rail on said first side, and a second ground-rail on said second side said second ground-rail being generally parallel to said first ground-rail, said two ground-rails having a first end and a second end, a plurality of pairs of support bar means, one bar of each pair being mounted by a first end on said first ground-rail and the other bar of the pair being mounted by a first end on said second ground-rail, the two bars of each pair being generally coplanar with one another, of said plurality of pairs of support bar means:

a first pair of said support bar means being mounted at said first end of the ground-rails, a second pair of said support bar means being located at said second end of the ground-rails, a third pair of said support bar means being located in the area between said first and second pair of support bar means, the mounting of said second and third pairs on the ground-rails being by rotatable mounting means, said second and third pairs each being rotatable about said rotatable mounting means in a vertical arc that is coplanar with a line that is parallel with the ground-rails, each of said support bar means including a second end, and each pair of support bar means comprising a spacer bar at said second ends of said support bar means of said each pair, the mounting of said first pair of said support bar means being by rotatable mounting means, said first pair being rotatable about said rotatable mounting means in a vertical arc that is coplanar with a line that is parallel with the ground-rails, and flange means mounted on a bar of said first pair of said support bar means, and flange means mounted on a bar of said second pair of said support bar means, said flange means being for receiving wheels of said vehicle for holding said flanged bars to the ground.

5. A portable cover for a vehicle having a first side, a second side, a first end, a second end, a wheel at said first end, ad a wheel at said second end, said cover comprising:

a foldable frame and weather resistant flexible sheet means attached to said frame for protecting the vehicle from weather, said frame comprising a first ground-rail on said first side, and a second ground-rail on said second side said second ground-rail being generally parallel to said first ground-rail, said two ground-rails having a first end and a second end, a plurality of pairs of support bar means, one bar of each pair being mounted by a first end on said first ground-rail and the other bar of the pair being mounted by a first end on said second ground-rail, the two bars of each pair being generally coplanar with one another, of said plurality of pairs of support bar means:

a first pair of said support bar means being mounted at said first end of the ground-rails, a second pair of said support bar means being located at said second end of the ground-rails, a third pair of said support bar means being located in the area between said first and second pair of support bar means, the mounting of said second and third pairs on the ground-rails being by rotatable mounting means, said second and third pairs each being rotatable about said rotatable mounting means in a vertical arc that is coplanar with a line that is parallel with the ground-rails, each of said support bar means including a second end, and each pair of support bar means comprising a spacer bar at said second ends of said support bar means of said each pair, the mounting of said first pair of said support bar means being by rotatable mounting means, said first pair being rotatable about said rotatable mounting means in a vertical arc that is coplanar with a line that is parallel with the ground-rails, and flange means mounted on a bar of said first pair of said support bar means, and flange means mounted on a bar of said second pair of said support bar means, said flange means being for receiving wheels of said vehicle for holding said flanged bars to the ground, a spacer ground strip attached, with one end at said flange on the bar of said first pair of said support bar means, attached between said support bars of said first pair of support bar means, and a spacer ground strip attached, with one end at said flange on the bar of said second pair of said support bar means, attached between said support bars of said second pair of support bar means.

* * * * *